US005449241A

United States Patent [19]

Matsui et al.

[11] Patent Number: 5,449,241

[45] Date of Patent: Sep. 12, 1995

[54] PRINTING APPARATUS

[75] Inventors: Masaaki Matsui, Hirakata; Akira Katsura, Amagasaki; Satoshi Yamaura, Osaka, all of Japan

[73] Assignee: Matsushita Electric Industrial Co., Ltd., Osaka, Japan

[21] Appl. No.: 158,935

[22] Filed: Nov. 29, 1993

[30] Foreign Application Priority Data

Nov. 30, 1992 [JP] Japan ..... 4-319652

[51] Int. Cl.[6] ..... B41J 19/80

[52] U.S. Cl. ..... 400/314; 400/577; 400/645

[58] Field of Search ..... 400/313, 314, 314.2, 400/314.6, 315, 320, 545, 564, 572, 574, 577, 317, 317.1, 641, 642, 643, 645, 578

[56] References Cited

U.S. PATENT DOCUMENTS

| | | | |
|---|---|---|---|
| 4,500,217 | 2/1985 | Swindler | 400/314 |
| 4,958,949 | 9/1990 | Haftmann et al. | 400/314 |
| 5,152,622 | 10/1992 | Rasmussen et al. | 400/642 |
| 5,160,205 | 11/1992 | Mistyurik | 400/248 |
| 5,230,576 | 7/1993 | Sone | 400/649 |

*Primary Examiner*—Ren Yan

*Attorney, Agent, or Firm*—Ratner & Prestia

[57] ABSTRACT

A printing apparatus including a paper guide, provided on a frame for guiding recording paper; a platen pivotally supported by the frame; a paper feeding roller rotatably provided in the frame; and a printing driving section reciprocally moving with respect to the recording paper on the platen for performing printing, and a cam rack in engagement with the paper feeding roller for intermittently rotating the paper feeding roller. The cam rack has a projection to be engaged with the paper feeding roller for stopping the rotation of the paper feeding roller.

13 Claims, 8 Drawing Sheets

PRINTING APPARATUS

BACKGROUND OF THE INVENTION

1. Field of the Invention

The present invention relates to a compact printing apparatus for use in a measuring apparatus, medical equipment, a POS (point-of-sale) terminal, a telephone and the like.

2. Description of the Related Art

In various industrial fields, higher quality has been demanded for a printing apparatus as well as compactness and inexpensiveness.

In the field of thermal printers, the number of components and the number of production processes has been reduced to comply with the demand for lower prices. Moreover, printers having low noise and multiple functions are demanded as the uses thereof are varied. Regarding quality, drawings and graphs are now printed in addition to letters. More precise paper feeding is required for accurate drawings and graphs.

Referring briefly to FIG. 10, there is shown an exploded isometric view of a conventional printing apparatus. The printing apparatus 100 of FIG. 10 includes a frame 1 formed of metal having a bottom wall. Side walls 2 and 3 are fixed to the frame 1. A paper guiding plate 8 for guiding thermal paper used as recording paper 16 to a printing position, a platen holder 15 for supporting a platen 17 so that the platen 17 can be pivoted, and a sliding shaft 7 for guiding a carriage 6 are supported by the side walls 2 and 3. A rack 4 having a cam slope **4*b* is attached to the frame 1. A printing head 5 is supported by the carriage 6. The carriage 6 also has a stepping motor 6*a* provided on a top surface thereof, and a gear 6*b* directly connected to the stepping motor 6*a* and a head-up cam 6*c* provided on a bottom surface thereof. The gear 6*b* is engaged with the rack 4 by springs 4*a*, and the head-up cam 6*c* is to be rotated against and slid on the cam slope 4*b*. The printing head 5 is pressed on the recording paper 16 by a coil spring 5*a* provided between the carriage 6 and the printing head 5. The printing head 5 is supplied with electric energy by a flexible printed circuit board 5*b*** (hereinafter, referred to as the "FPC") for printing.

Leaf springs 9 are welded to the paper guiding plate 8 so as to press the recording paper 16 on paper feeding rollers **10*a* formed of rubber. The paper feeding rollers 10*a* are provided at specified positions of a paper feeding roller shaft 10, integrally therewith. A wheel 11 having radial teeth 11*a* is fixed to the paper feeding roller shaft 10. A ratchet gear 12 is rotatably provided inside the wheel 11. The ratchet gear 12 has teeth which are engaged with the radial teeth 11*a* by a compression spring 13. The ratchet gear 12 is also engaged with a rack gear 14*a* formed at an end of a cam plate 14. The ratchet gear 12 and the rack gear 14*a* act as a one-way clutch mechanism rotating in one direction. The cam plate 14 has a groove 14*b* engaged with a pin (not shown) formed on the carriage 6. As is illustrated, one end (curved portion) 14*c* of the groove 14*b*** is curved or bent.

The operation of the printing apparatus having the above-mentioned construction will be described with reference to FIGS. **11*a* and 11*b*, which shows the relationship between the movement of the carriage 6 and the operation of the printing head 5**.

The recording paper 16 is inserted from the rear side of the paper guiding plate 8 and fed between the pinching leaf springs 9 and the paper feeding rollers **10*a* onto a forward surface of the platen 17**.

Then, the stepping motor **6*a* is driven to rotate. Due to the engagement of the gear 6*b* connected to the stepping motor 6*a* and the rack 4, the rotation of the stepping motor 6*a* is transmitted to the carriage 6, thereby moving the carriage 6 along the sliding shaft 7 rightward as shown in FIG. 11B. While the carriage 6 moves rightward, the printing head 5 is supplied with electric energy in phase with the movement of the carriage 6, thereby performing printing on the thermal paper used as the recording paper 16. When printing of one line is completed, the carriage 6 moves leftward as shown in FIG. 11A and the cam plate 14 is pivoted due to the engagement of the pin formed on the carriage 6 and the curved portion 14*c* of the groove 14*b*. Then, the ratchet gear 12 in engagement with the rack gear 14*a* is rotated by a certain distance, and the rotation thereof is transmitted to the wheel 11. Then, the paper feeding rollers 10*a* integral with the wheel 11 are rotated by a certain distance to advance the recording paper 16. The headup cam 6*c* is rotated against and slid along the cam slope 4*b* to separate the printing head 5 from the platen 17. When reaching an end of the cam slope 4*b*, the head-up cam 6*c* is rotated oppositely by a returning spring (not shown) in a separation stabilization area; this operation of the head-up cam 6*c* presses the printing head 5 on the recording paper 16**.

The above-mentioned printing apparatus has a large number of components, and thus production cost is high. Further, there are some problems concerning precision of paper feeding.

One of the problems occurs when the recording paper 16 is cut. Since the ratchet gear 12 and the rack gear **14*a* act as a one-way clutch mechanism, the recording paper 16 is pulled freely, that is an extra amount of the recording paper 16 is pulled out. Further, due to the one-way clutch mechanism, the ratchet gear 12 and the rack gear 14*a*** are displaced with respect to each other, and thus the margin can vary for the top line of the next page.

Another problem concerning precision of paper feeding lines occurs because of the pivotable platen 17. While the recording paper 16 is fed, the slanting angle of the platen 17 changes by the friction between the platen 17 and the recording paper 16, thereby loosening the recording paper 16. As a result, the margin can vary for the top line of the next page. Further, when the head-up cam **6*c* is rotated oppositely for pressing the printing head 5 on the recording paper 16, the force of the coil spring 5*a*** suddenly acts, thereby making a noise.

SUMMARY OF THE INVENTION

According to the present invention, a printing apparatus includes a paper guide provided on a frame for guiding recording paper; a platen pivotally supported by the frame; a paper feeding roller rotatably provided in the frame; a printing driving section reciprocally moving with respect to the recording paper on the platen for performing printing, and a cam rack in engagement with the paper feeding roller for intermittently rotating the paper feeding roller. The cam rack having a projection to be engaged with the paper feeding roller for stopping the rotation of the paper feeding roller.

Alternatively, a printing apparatus includes a resin frame having a bottom wall and side walls provided at two ends of the bottom wall; a paper feeding roller provided in the frame for guiding recording paper to a printing position; and a printing head for performing printing on the recording paper fed by the paper feeding roller. The bottom wall of the frame has a paper guide provided integrally provided thereon. The paper guide has an elastic member provided thereon for pressing the recording paper on the paper feeding roller.

Thus, the invention described herein makes possible the advantage of simplifying a printing apparatus, improving paper feeding precision, and lowering noise.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

A first example of a printing apparatus 18 according to the present invention will be described.

Figure 1:
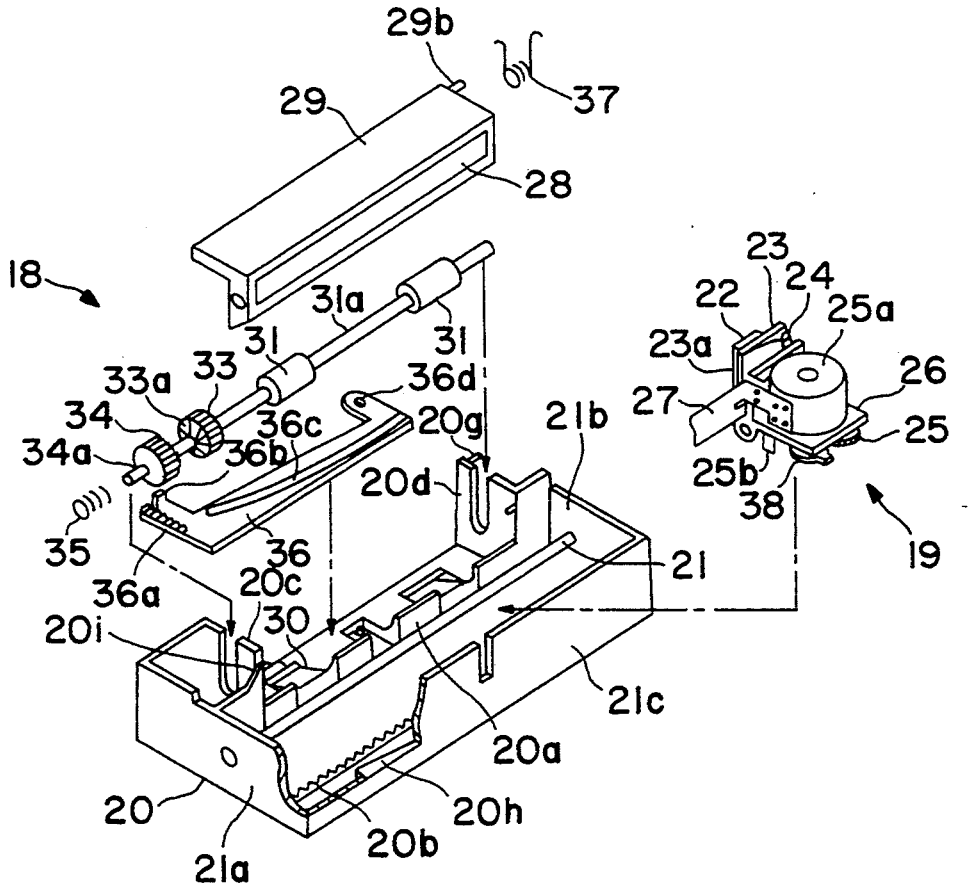
FIG. 1 is an exploded isometric view of a printing apparatus in a first example according to the present invention.
Figure 2:
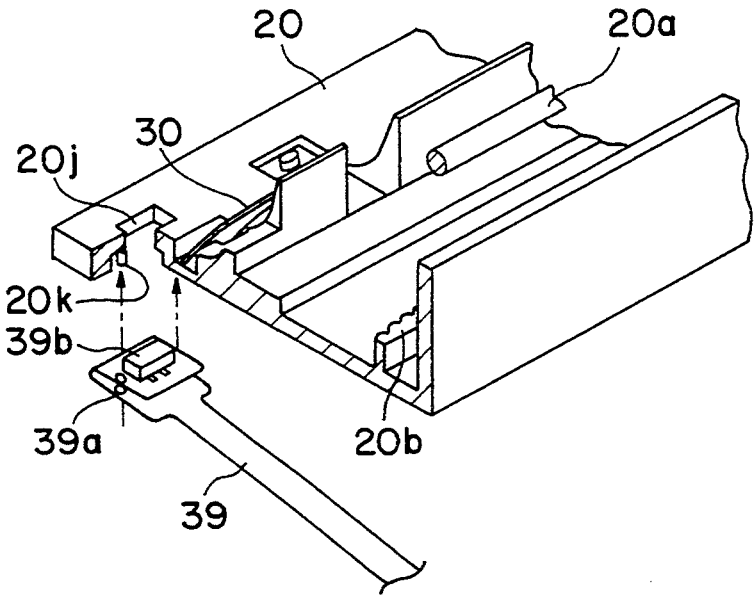
FIG. 2 is an enlarged partial isometric view partly broken away in section of the printing apparatus of FIG. 1.
Figure 3:
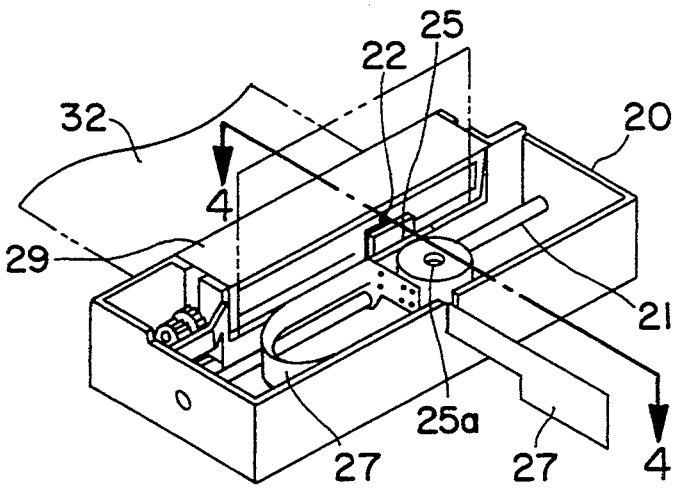
FIG. 3 is an isometric view in the state where the parts shown in FIG. 1 are assembled.
Figure 4:
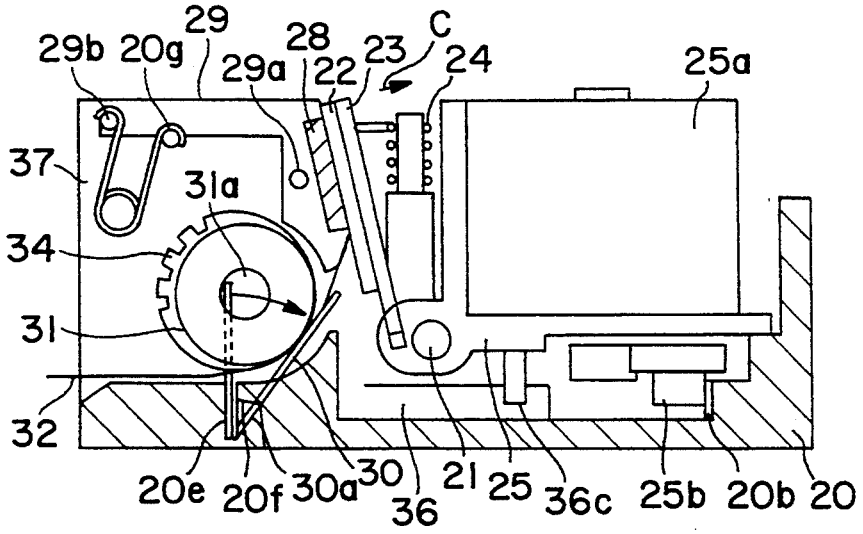
FIG. 4 is a cross sectional view of the printing apparatus shown in FIG. 1 to show section line 4—4 in FIG. 3.

FIG. 1 is an exploded isometric view of the printing apparatus 18; FIG. 2 is an enlarged partial isometric view partly broken away in section of the printing apparatus 18 of FIG. 1; FIG. 3 is an isometric view thereof in the state where the parts shown in FIG. 1 are assembled; and FIG. 4 is a cross sectional view of the printing apparatus 18 to show section line 4—4 in FIG. 3.

The printing apparatus 18 includes a frame 20 formed of a resin having a paper guide 20*a*, a frame rack 20*b*, and inner frame side walls 20*c* and 20*d*. The printing apparatus 18 further includes a printing driving section 19 having a printing head 22 for performing printing on thermal paper used as recording paper 32, and a heat releasing plate 23 which also mounts the printing head 22 relative to a carriage 26. The heat releasing plate 23 is slidably supported by the carriage 26 of the printing driving section 19 and is pressed to be in contact with a platen 28 by a torsion spring 24. The printing driving section 19 also includes a stepping motor 25*a*, a pin 25*b*, and a head-up cam 38, as is illustrated in the drawings.

A metal sliding shaft 21 extends between outer side walls 21*a* and 21*b* of the frame 20. The printing driving section slides along the metal sliding shaft 21 rightward and leftward, thereby feeding recording paper 32 and performing printing. The stepping motor 25*a* is mounted on the carriage 26, and rotation thereof is transmitted to a frame gear 25, which is in engagement with the frame rack 20*b*. A flexible printing circuit board (hereinafter, referred to as the "FPC") 27 is provided in the frame 20 is provided for supplying electric energy to the printing head 22 and the like.

The frame 20 further includes a first cam slope 20*h* which generally slopes in the direction from the front wall 21*c* of the frame 20 toward the platen 28, as is seen in FIG. 1. The first cam slope 20*h* is intended to contact the head-up cam 38 provided on a bottom surface of the carriage 26, on an identical plane with that of the frame gear 25 to separate the printing head 22 from the platen 28.

The frame 20 further includes a second cam slope 20*i* having a slope slanting oppositely to the first cam slope 20*h*, namely, from the edge or end of the inner frame side wall 20*c* toward the outer side wall 21*a*. The second cam slope 20*i* is positioned to contact the heat releasing plate 23 to separate the printing head 22 from the platen 28.

Figure 5:
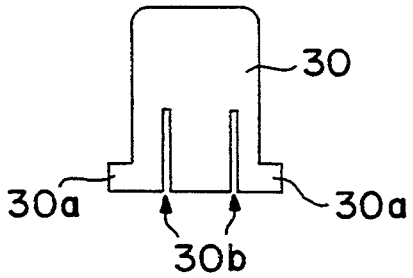
FIG. 5 is a front view of a leaf spring used in a printing apparatus according to the present invention.
Figure 6A:
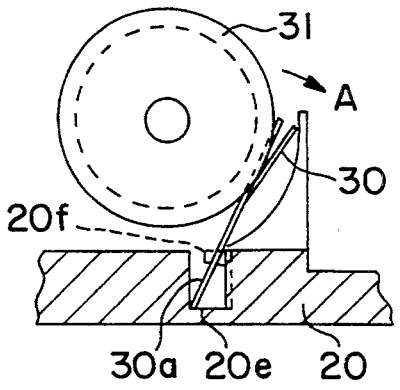
FIG. 6A is view illustrating the leaf spring provided in a printing apparatus according to the present invention.
Figure 6B:
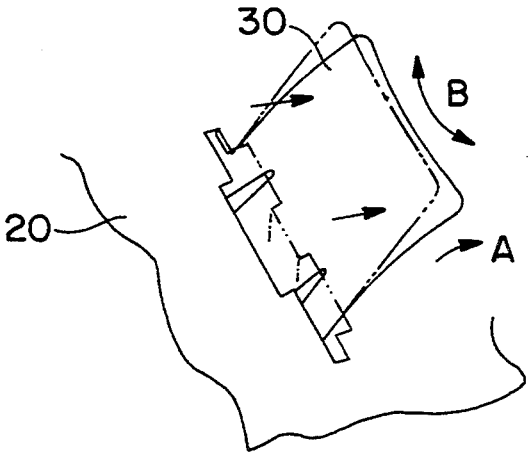
FIGS. 6B and 6C are views illustrating how the leaf spring is bent.
Figure 6C:
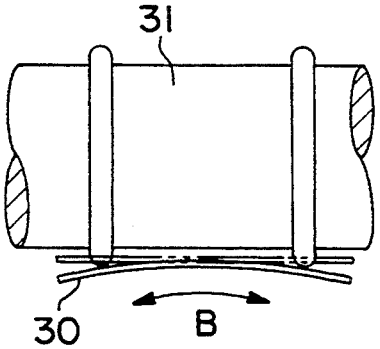

The frame 20 further includes leaf springs 30. As is illustrated in FIG. 5, each of the leaf springs 30 has cutouts 30*b* and ears 30*a* projected outward. As is illustrated in FIGS. 4 and 6A, the ears 30*a* are respectively inserted into slits 20*e* formed in the frame 20. When the leaf spring 30 is slanted as indicated by a solid line, the ears 30*a* are positionally restricted by a wall 20*f* provided on the paper guide 20*a*. The frame 20 accommodates a paper feeding rollers 31 formed of rubber and supported by a roller shaft 31*a*, which is rotatably supported by the frame 20. In the state where the leaf spring 30 is thus slanted and the paper feeding rollers 31 is in contact with the leaf spring 30, the recording paper 32 is held in position as is illustrated in FIG. 4 by the elastic force of the leaf spring 30. As is shown in FIG. 6B, a surface of the paper feeding rollers 31 has projected portions corresponding to two side ends of the leaf spring 30. Therefore, when the paper feeding rollers 31 is pressed on the leaf spring 30, the leaf spring 30 is bent in directions A and B as is shown in FIGS. 6A, 6B and 6C.

Figure 7:
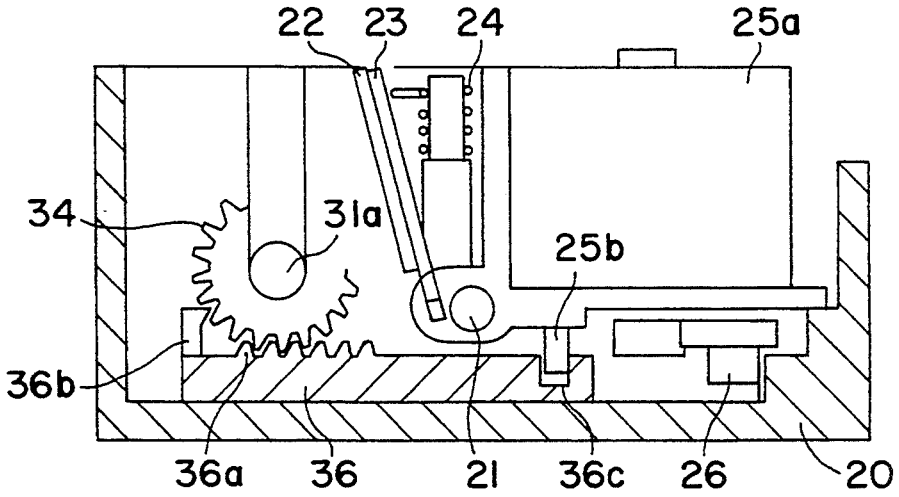
FIG. 7 is a cross sectional view illustrating an area between the frame and the ratchet gear of the printing apparatus shown in FIG. 1.

The paper feeding roller shaft 31*a* has a gear 33 and a ratchet gear 34 provided therearound. The gear 33 is integrally formed with the roller shaft 31*a* which are made of a resin material. The ratchet gear 34 is pressed by a spring 35 in order to keep teeth 34*a* on an end face of the ratchet gear 34 in contact with teeth 33*a* on an end face of the gear 33. A cam plate 36 is pivotally supported around a support 36*d*. As is shown in FIG. 7, a cam rack 36*a* formed at an end of the cam plate 36 is in engagement with the ratchet gear 34. The cam rack 36*a* and the ratchet gear 34 act as a ratchet mechanism. The pin 25*b* formed on a bottom surface of the carriage 26 is in engagement with a curved groove 36*c* of the cam plate 36. As the carriage 26 moves along the metal sliding shaft 21, the cam plate 36 pivots and accordingly the cam rack 36*a* pivots. The pivoting movement is converted into rotation of the ratchet gear 34. The rotation is transmitted to the paper feeding rollers 31 through the gear 33, thereby rotating the paper feeding rollers 31 by a specified distance in a specified direction. When the carriage 26 reaches an end of the frame 20 on the side of the side wall 20*c*, namely, when printing of one line is completed, a projection 36*b* of the cam plate 36 engages the gear 33. Thus, the gear 33 and the paper feeding rollers 31 integrally formed therewith are locked.

The platen 28 is attached to a platen holder 29, which is pivotally supported by the frame 20 around a support pin 29*a* (FIG. 4). When printing of one line is finished, the printing head 22 which has been in pressure contact with the recording paper 32 is moved in a direction shown by an arrow C, and the recording paper 32 is fed forward by one line, as is described further below. A torsion spring 37 is provided for preventing the platen 28 from slanting due to friction between the recording paper 32 and the platen 28.

The torsion spring 37 is provided between a support pin 29*b* of the platen holder 29 and a support pin 20*g* formed on the frame 20, thereby elastically separating the support pin 29*b* and the support pin 20*g* to arrange the support pins 29*b* and 20*g* and the support pin 29*a* on one straight line.

As is shown in FIG. 2, a reflection-type photosensor 39*b* is soldered to an FPC 39 having an end portion which is folded. The FPC 39 has holes 39*a* in the folded end portion. The positions of the holes 39*a* corresponds to each other in the vertical direction. The FPC 39 is fixed to the frame 20 in such a manner that a pin 20*k* formed integrally with the frame 20 is inserted into the holes 39*a* under pressure. The photosensor 39*b* is inserted into a hole 20*j* of the frame 20. With the above-mentioned construction, light is reflected from a paper sheet when the sheet passes over the surface of the photosensor 39*b*. The photosensor 39*b* detects whether the light is reflected or not, so as to determine the presence or absence of paper.

Figure 8A:
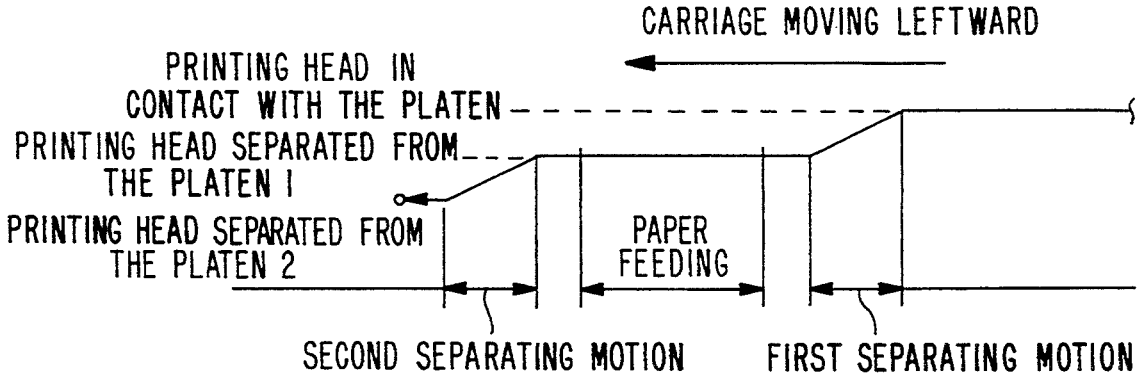
FIGS. 8A and 8B are graphs showing the relationship between the movement of the carriage and the printing head.
Figure 8B:
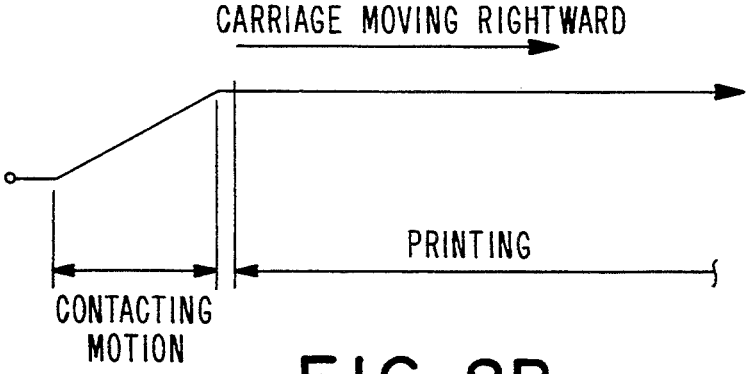

The printing apparatus having the above-described construction is operated in the following manner. FIGS. 8A and 8B show the relationship between the movement of the carriage 26 and the operation of the printing head 22.

The recording paper 32 is inserted from the rear side of the paper guide 20*a* (FIG. 1) and fed between the leaf springs 30 and the paper feeding rollers 31 onto a front surface of the platen 28.

Then, the stepping motor 25*a* is driven to rotate. The rotation of the stepping motor 25*a* is transmitted to the carriage 26 through the frame gear 25. Due to the engagement of the frame rack 20*b* and the frame gear 25, the carriage 26 moves along the sliding shaft 21. While the carriage 26 moves rightward, the printing head 22 is supplied with electric energy by the FPC 27 and performs printing.

When the printing of one line is completed, the carriage 26 moves leftward, thereby putting the first cam slope 20*h* and the head-up cam 38 into contact with each other to separate the printing head 22 from the platen 28. When the carriage 26 moves further leftward, the second cam slope 20*i* and the heat releasing plate 23 are put into contact with each other to move the printing head 22 further away from the platen 28. While the printing head 22 moves further away from the platen 28, the cam plate 36 and the cam rack 36*a* are pivoted by the engagement of the pin 25*b* and the curved groove 36*c* to advance the recording paper 32 by one line. The pivoting movement is converted into rotation of the ratchet gear 34. The rotation is transmitted to the paper feeding rollers 31 through the gear 33, thereby rotating the paper feeding rollers 31 by a specified distance in a specified direction. When the carriage 26 reaches the left end of the frame 20, namely, when printing of one line is completed, a projection 36*b* of the cam plate 36 engages the gear 33. Thus, the gear 33 and the paper feeding rollers 31 integrally formed therewith are locked.

When the feeding of the recording paper 32 by one line is completed, the carriage 26 moves rightward. The printing is performed in the same manner, and the cam plate 36 is retracted to the original position thereof. At this time, the paper feeding rollers 31 does not rotate due to a one-way clutch mechanism of the ratchet mechanism.

The printing is repeated line by line in this manner. When the printing of all the lines is finished, the carriage 26 stops at the left end of the platen 28, and the projection 36*b* is engaged with the gear 33. The paper feeding rollers 31 is thus locked.

In this example, the cam plate 36 is used for driving the ratchet mechanism, but any other system may be used.

EXAMPLE 2

Figure 9:
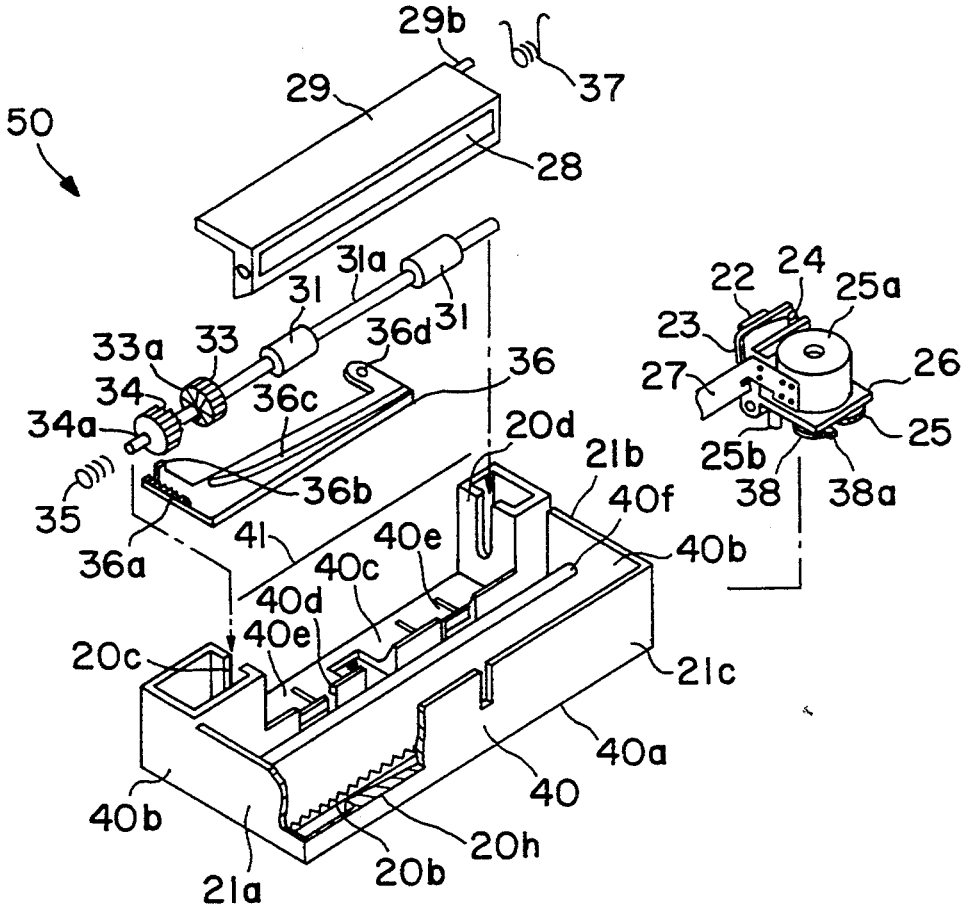
FIG. 9 is an exploded isometric view of a printing apparatus in a second example according to the present invention.
Figure 10:
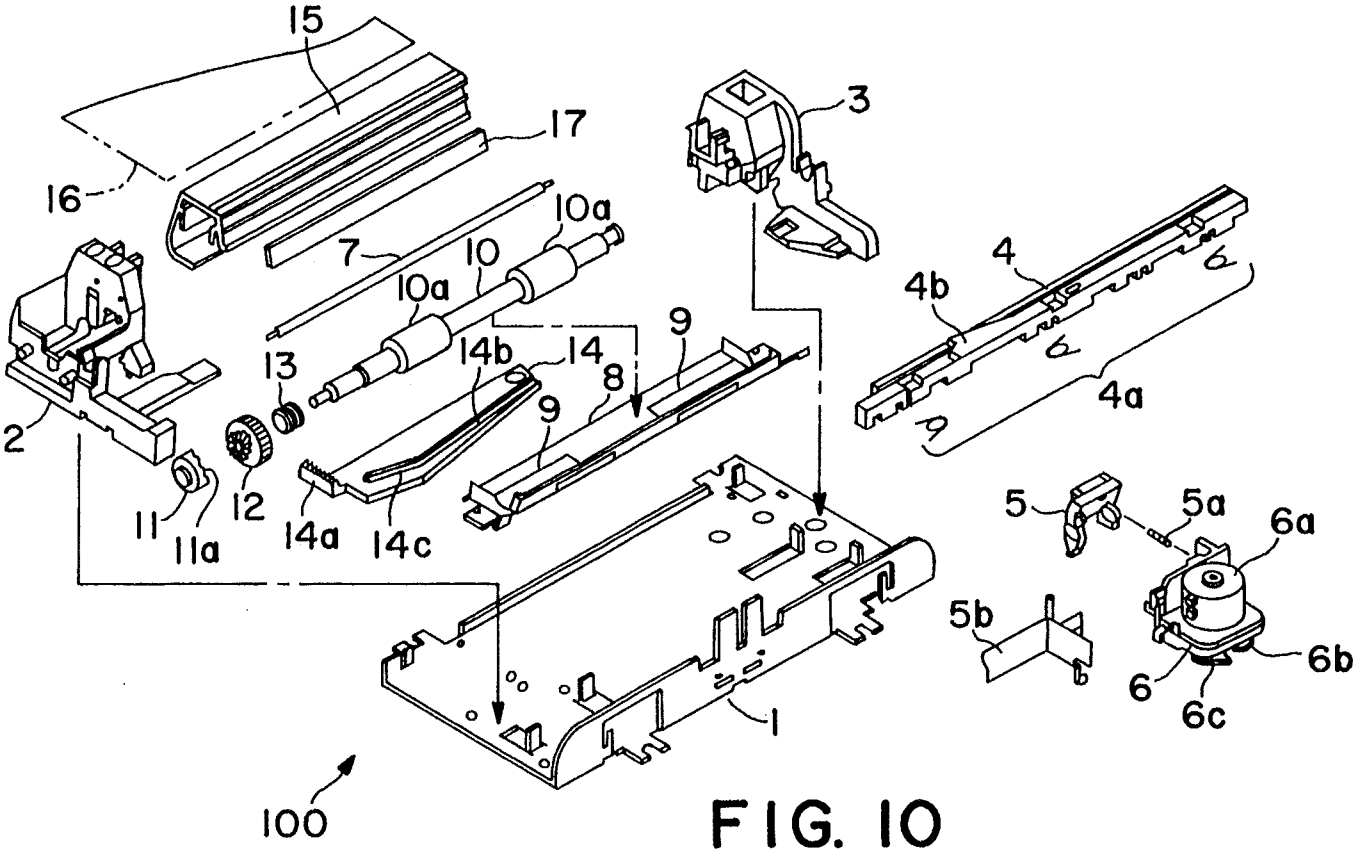
FIG. 10 PRIOR ART
FIG. 10 is an exploded isometric view of a conventional printing apparatus summarily described above.

A second example of a printing apparatus 50 according to the present invention will be described with reference to FIG. 9. FIG. 9 is an exploded isometric view of the printing apparatus 50. Identical elements with those in the first example bear identical reference numerals therewith.

The printing apparatus 50 includes a frame 40 formed of a resin. The printing head 22 supported by the carriage 26 is put into pressure contact with the recording paper (not shown) and the platen 28, and supplied with electric energy by the FPC 27 to perform printing.

The frame 40 has a bottom wall 40*a* and side walls 40*b* provided at two ends of the bottom wall 40*a*. A paper guide 40*c* for guiding the recording paper to a printing position is provided integrally with the bottom wall 40*a* of the frame 40. The paper guide 40*c* has slits 40*d* at which elastic pieces 40*e* for pressing the recording paper onto a paper feeding rollers 31 are provided integrally with the bottom wall 40*a*. The frame 40 further includes a sliding shaft 40*f* for slidably supporting the carriage 26, the sliding shaft 40*f* being supported by the side walls 40*b*. The sliding shaft 40*f* and the side walls 40*b* are integrally formed with the frame 40. An elastic linear rod 41 is provided between the paper guide 40*c* and the elastic pieces 40*e* to help maintain the elasticity of the elastic pieces 40*e* substantially constant regardless of the environmental temperature.

The printing apparatus 50 in the second example has an identical construction to the printing apparatus 18 except for the above-mentioned points.

The printing apparatus 50 having the above-described construction is operated in the following manner.

The recording paper is inserted from the rear side of the paper guide 40*c* along the paper feeding rollers 31 onto the platen 28. The pressure of the elastic pieces 40*e* on the paper feeding rollers 31 is kept at a certain level or higher.

Then, the stepping motor 25*a* is driven to rotate. The rotation of the stepping motor 25*a* is transmitted to the printing driving section through the frame gear 25. Due to the engagement of the frame rack 20*b* and the frame gear 25, the carriage 26 moves rightward along the sliding shaft 21. Electric energy is applied to the printing head 22 by the FPC 27 in phase with the movement of the carriage 26, thereby performing printing on the thermal paper used as the recording paper.

When the printing of one line is completed, the carriage 26 moves leftward, thereby putting the first cam slope 20*h* and the head-up cam 38 into contact with each other. Thus, the printing head 22 is separated from the platen 28. When the carriage 26 moves further leftward, the second cam slope 20*i* and the heat releasing plate 23 are put into contact with each other, thereby moving the printing head 22 further away from the platen 28. While the printing head 22 moves further away from the platen 28, the cam plate 36 and the cam rack 36*a* are pivoted by the pin 25*b*, thereby advancing the recording paper (shown in FIG. 3, for example, at 32) by one line. The pivoting movement is converted into rotation of the ratchet gear 34. The rotation is transmitted to the paper feeding rollers 31 through the gear 33, thereby rotating the paper feeding rollers 31 by a specified distance in a specified direction. When the carriage 26 reaches an end of the frame 40 on the side of the side wall 20*c*, namely, when printing of one line is completed, a projection 36*b* of the cam plate 36 engages the gear 33. Thus, the gear 33 and the paper feeding rollers 31 integrally formed therewith are locked.

When the feeding of the recording paper 32 by one line is completed, the carriage 26 moves rightward. The printing is performed in the same manner, and the cam plate 36 is retracted to the original position thereof. At this time, the paper feeding rollers 31 does not rotate due to a one-way clutch mechanism of the ratchet mechanism.

The printing is repeated line by line in this manner. When the printing of all the lines is finished, the carriage 26 stops at the left end of the platen 28, and the projection 36*b* is engaged with the gear 33. Thus, the paper feeding rollers 31 is locked.

The respective elastic pieces 40*e* can press the recording paper against the paper feeding rollers 31 at one or more points of contact. In the case that there are two points of contact, this allows the recording paper to be wrapped circumferentially around the paper feeding rollers 31 for a longer length. Therefore, the positional restriction of the recording paper with respect to the paper feeding rollers 31 is increased. Thus, the recording paper is held more securely, and the influence of an external force on the precision of paper feeding is reduced.

According to the present invention, a simple mechanism for holding the recording paper with a small number of components is realized only by providing a leaf springs 30 of FIGS. 1 to 6 (6A, 6B and 6C) or the equivalent elastic pieces 40*e* of FIG. 9. The leaf springs 30 or the equivalent elastic pieces 40*e* also prevent the platen from slanting or pivoting while paper feeding and thus keeps the recording paper taut, thereby improving precision of paper feeding. Further, since the paper feeding roller is locked while the recording paper is cut, the margin is kept constant for the top line of the next page.

Figure 11A:
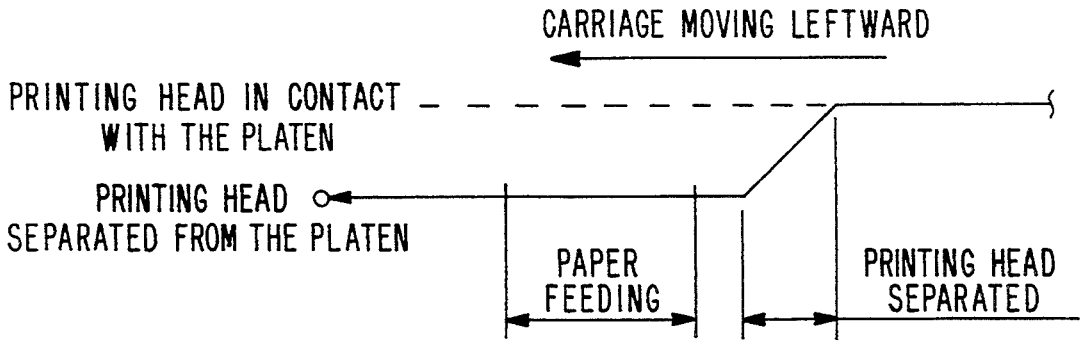
FIG. 11A PRIOR ART
FIGS. 11*a* and 11*b* are graphs showing the relationship between the movement of the carriage and the printing head of the conventional printing apparatus of FIG. 10.
Figure 11B:
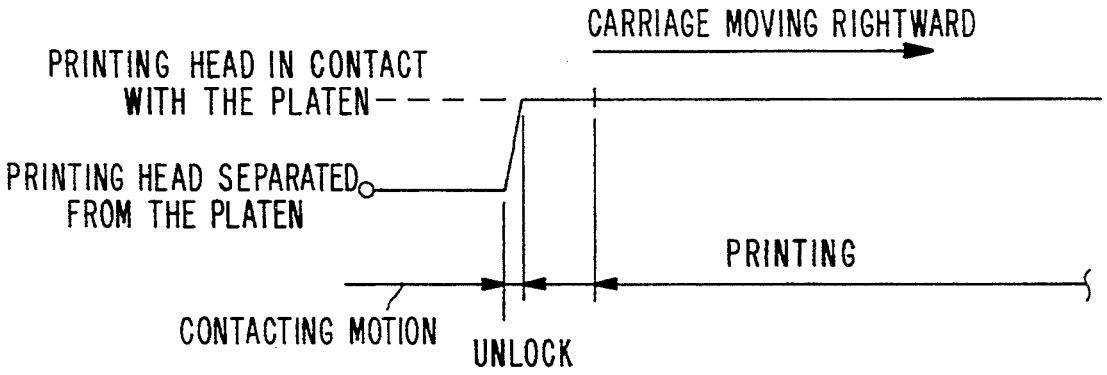
FIG. 11B PRIOR ART

The printing head is separated from the platen by two stages. Accordingly, the load applied to the stepping motor is also divided into two, thereby stabilizing the separating operation, as is especially apparent from a comparison of FIGS. 8 and 11. Further, since the heat releasing plate is moved along the second cam slope, no sudden shock is generated, and thus the noise is kept low.

Since the leaf springs each have one or more slits, the spring constant can be kept low. Accordingly, the recording paper is inserted in a stable manner. Since the leaf spring is bent in two directions, the end faces of the leaf spring is prevented from contacting and thus damaging the recording paper.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A printing apparatus, comprising:

a frame including paper guide means for guiding a recording paper;

a platen pivotably supported by the frame;

a paper feeding roller rotatably provided in the frame;

printing driving means including a printing head for reciprocally moving with respect to the recording paper on the platen for performing printing, and;

cam rack means in engagement with the paper feeding roller and said printing driving means for intermittently rotating the paper feeding roller, the cam rack means having a projection to be engaged with the paper feeding roller for stopping the rotation of the paper feeding roller when the printing driving means is at a prescribed position in its reciprocal movement and for not being engaged with the paper feeding roller when the printing driving means is at other positions in its reciprocal movement.

2. A printing apparatus according to claim 1, further comprising an elastic member for loading the platen in a single direction.

3. A printing apparatus according to claim 1, wherein the paper guide means has a slit formed vertically in the paper guide means, the apparatus further comprising a substantially flat leaf spring inserted into the slit, and wherein the recording paper is pressed on the paper feeding roller by elastic force of the leaf spring.

4. A printing apparatus according to claim 3, the leaf spring has at least one cutout to facilitate bending in a plurality of directions.

5. A printing apparatus according to claim 1, wherein the printing driving means has a carriage, the apparatus further comprising a driving gear and a head-up cam both provided on the carriage, and a first cam slope included on the frame for engaging the head-up cam along a path of the reciprocal movement of the printing driving means to separate the printing head from the platen.

6. A printing apparatus according to claim 5, wherein the printing head has a front surface facing the recording paper and a rear surface, the apparatus further comprising a heat releasing plate adjacent to the rear surface of the printing head, an elastic member which urges the heat releasing plate toward the platen, and a second cam slope included on the frame for engaging the heat releasing plate along the path of the reciprocal movement of the printing driving means to move the printing head further away from the recording paper.

7. A printing apparatus according to claim 1, wherein said prescribed position represents a position the printing driving means stops at upon completion of a print line.

8. A printing apparatus according to claim 1, wherein said prescribed position represents a position the printing driving means stops at upon completion of a printing operation.

9. A printing apparatus, comprising:

a resin frame having a bottom wall and side walls provided at two ends of the bottom wall;

a paper feeding roller provided in the frame for guiding recording paper to a printing position;

a printing head for performing printing on the recording paper fed by the paper feeding roller;

a paper guide provided integrally on the bottom wall of the frame;

an elastic member provided on the paper guide for pressing the recording paper on the paper feeding roller; and an elastic wire provided between the paper guide and the elastic member for assisting in maintaining the elasticity of the elastic member.

10. A printing apparatus according to claim 9, wherein the paper guide has a slit and the elastic member is provided at the slit.

11. A printing apparatus according to claim 9, wherein the elastic member is in pressure contact with the paper feeding roller at two points.

12. A printing apparatus according to claim 9, further comprising:

a carriage movable reciprocally along the paper guide while carrying the printing head; and a sliding shaft for slidably guiding the carriage, wherein said side walls extend from the bottom wall of the frame for supporting the sliding shaft, the sliding shaft and the side walls being integrally formed with the frame.

13. A printing apparatus according to claim 9, wherein the paper feeding roller has a resin roller shaft and a resin gear integrally provided thereon, and the resin roller shaft is provided with a rubber roller for contacting the recording paper, and the apparatus further includes a motor that transmits a rotational force to the resin gear.

* * * * *